US005348496A

United States Patent [19]

Ludwig

[11] Patent Number: 5,348,496

[45] Date of Patent: Sep. 20, 1994

[54] BREAK-OFF KEY FOR RELEASING PUSH-WIRE CONNECTION IN WIRING DEVICE

[75] Inventor: Melvin Ludwig, Great Neck, N.Y.

[73] Assignee: Eagle Electric Manufacturing Co., Inc., New York, N.Y.

[21] Appl. No.: 53,476

[22] Filed: Apr. 29, 1993

[51] Int. Cl.[5] ..... H01R 4/48

[52] U.S. Cl. ..... 439/441; 439/438

[58] Field of Search ..... 439/436–441

[56] References Cited

U.S. PATENT DOCUMENTS

| | | | |
|---|---|---|---|
| 2,738,482 | 3/1956 | Benander | 439/441 |
| 3,885,852 | 5/1975 | Grove | 439/441 |
| 4,172,628 | 10/1979 | Lingaraju | 439/441 |

*Primary Examiner*—Steven C. Bishop

*Attorney, Agent, or Firm*—Kirschstein, Ottinger, Israel & Schiffmiller

[57] ABSTRACT

A release key is detachably connected to a wiring device within easy access. After detachment from the wiring device, the key is insertable into a release passage in order to unlock and enable the removal of an uninsulated end portion of an electrical conductor from a terminal located within a housing of a wiring device.

17 Claims, 3 Drawing Sheets

FIG. 6
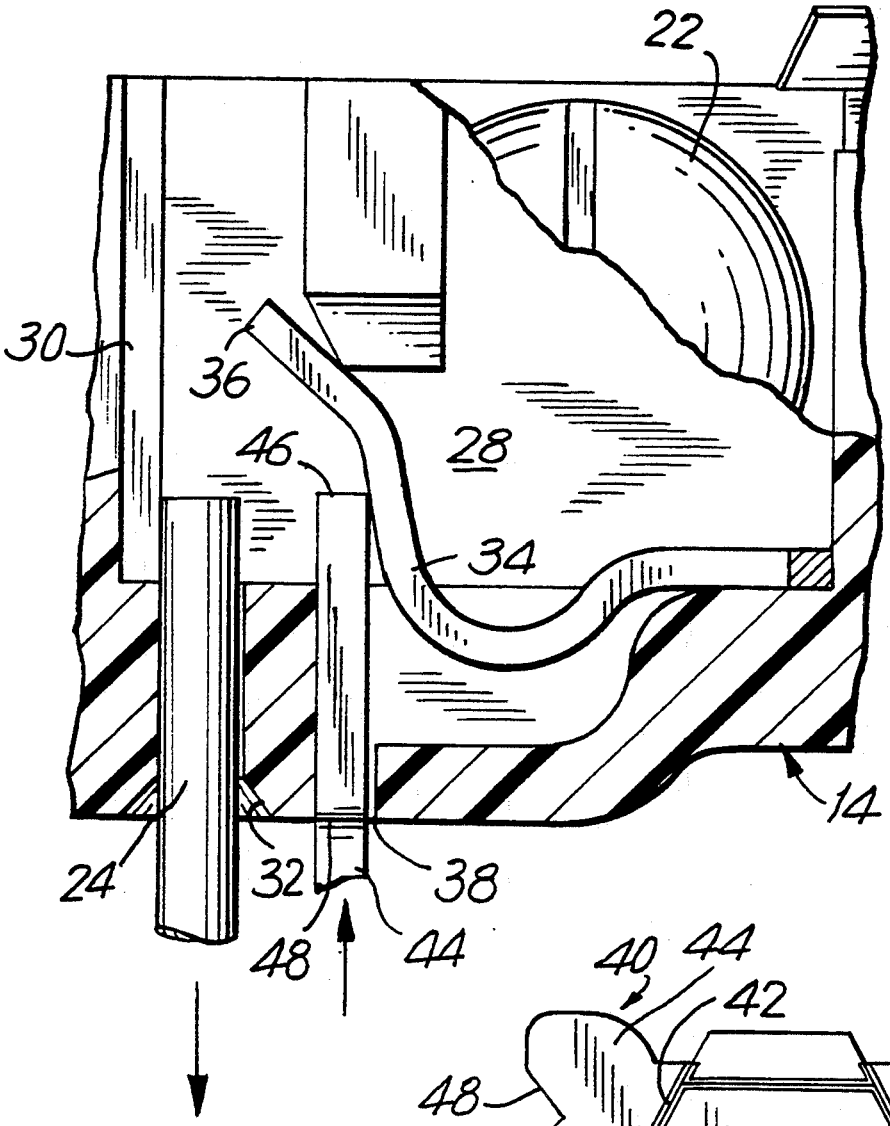
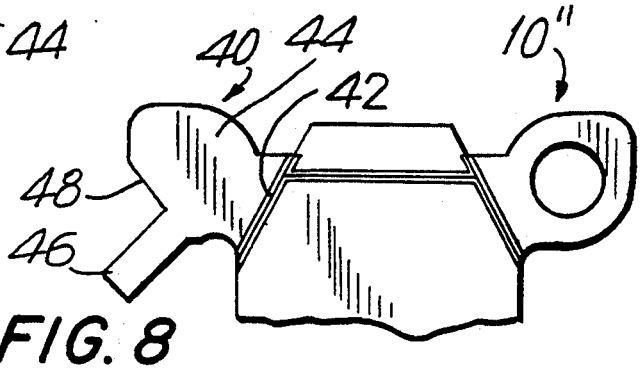
FIG. 8
FIG. 7
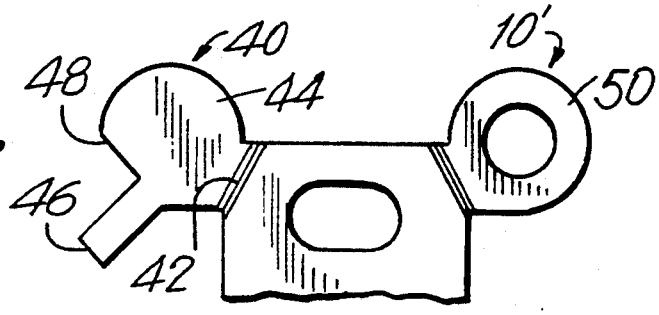
FIG. 9
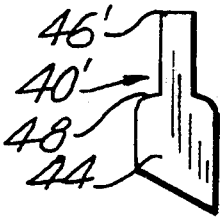

BREAK-OFF KEY FOR RELEASING PUSH-WIRE CONNECTION IN WIRING DEVICE

BACKGROUND OF THE INVENTION

1. Field of the Invention

This invention generally relates to the connection and release of electrical conductors to and from wiring devices such as wall-mounted switches and receptacles and, more particularly, to an improved release for push-wire connections in such devices.

2. Description of Related Art

It is well known that push-wire connections of electrical conductors to wiring devices such as wall-mounted switches and receptacles are simpler and quicker than screw-type connections. A bare end of the conductor is simply inserted in one direction into an opening in a housing for the device. An internal resilient spring clip or finger normally overlies the opening and is deflected out of the way by the bare conductor end during insertion. The resilience of the finger biases the bare conductor end into electrically-conductive contact with an interior terminal. The finger locks the bare conductor end in place to the terminal and actively resists removal of the bare conductor end in the event of a direct pull in the opposite direction.

It is conventional, for example, see U.S. Pat. No. 5,015,201, in such push-wired devices to provide a release passage adjacent the opening in which the conductor is inserted. A screwdriver blade is normally inserted into this release passage to engage and deflect the finger away from the bare conductor end, thereby releasing the same and enabling the bare conductor end to be removed from the opening.

Although generally satisfactory for their intended purpose of releasing the conductor, experience has shown that the known techniques for releasing the push-wire connection are not altogether effective. For example, a screwdriver having a blade small enough to fit inside a particular release passage is not always available. Even so, the blade may be inserted improperly or with excessive force, thereby damaging the finger and, in some instances, cracking the device housing. The device cannot or should not be used with a cracked housing, and certainly not with a damaged finger whose alignment has been altered or whose gripping force has been compromised.

SUMMARY OF THE INVENTION

1. Objects of the Invention

It is a general object of this invention to safely and easily remove a conductor from a push-wire connection in a wiring device.

It is another object of this invention to eliminate the reliance on screwdrivers to release a conductor from a push-wire connection.

Another object of this invention is to prevent damage to internal locking fingers and/or device housings during release of a conductor from a push-wire connection.

2. Features of the Invention

In keeping with these objects, and others which will become apparent hereinafter, one feature of this invention resides, briefly stated, in a wiring device for a push-wire connection with an uninsulated end portion of an electrical conductor. The device comprises a housing having an electrical terminal therein, an opening through which the uninsulated end portion is insertable, and a release passage adjacent to the opening. A locking means, e.g., a resilient finger, is located within the housing for locking the uninsulated end portion inserted through the opening in electrically-conductive contact with the terminal.

In accordance with one feature of this invention, a release means, e.g., a key, is detachably connected to the wiring device. After detachment from the wiring device, the key is insertable into the release passage, and is operative for unlocking and enabling the removal of the uninsulated end portion from the terminal.

In accordance with another feature of this invention, the key is not detached from a first wiring device from which the uninsulated end portion is intended to be removed. Instead, the key from a second wiring device, while remaining attached to the second wiring device, is inserted into the release passage of the first wiring device. This feature has the advantage that the second wiring device itself serves as a convenient handle to enable the key of the second wiring device to be conveniently manipulated without pressing into, and possibly injuring, an installer's fingers.

In the preferred embodiment, the housing has a mounting strap, constituted of either metal or plastic, and the key is integral with, and connected to, one of the ends of the strap along a weakened zone or score line. The key is thus always at hand, and there is no longer any need to search for a screwdriver blade having the correct size.

The key has a shank with a predetermined cross-section which is of complementary contour to the cross-section of the release passage. The key is slidably received in the passage with a snug sliding fit. Thus, the key cannot be manipulated improperly in the release passage.

In addition, the key is provided with a stop for limiting the insertion of the key into the release passage. This feature protects the finger from being damaged.

This invention also contemplates providing the key separate from the wiring device, thereby saving the installer the effort required to detach the key from the wiring device.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 6 is a view analogous to FIG. 5 during release of the conductor;

FIG. 7 is a view analogous to FIG. 2, but of another embodiment in accordance with this invention;

FIG. 8 is a view analogous to FIG. 2, but of still another embodiment of this invention; and FIG. 9 is a view of a separate release key.

DETAILED DESCRIPTION OF THE PREFERRED EMBODIMENTS

Figure 1:
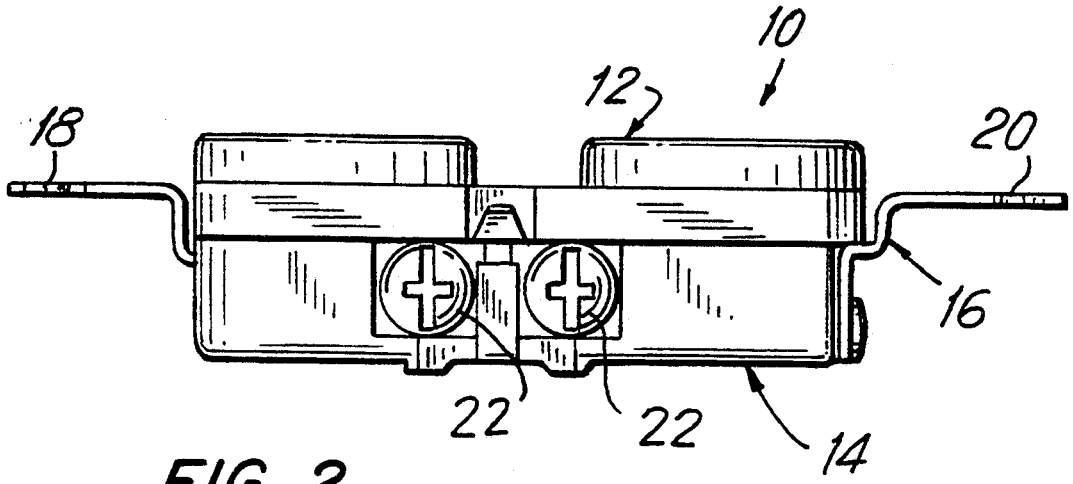
FIG. 1 is a side elevational view of a wiring device in accordance with this invention.

Referring now to the drawings, reference numeral 10 generally identifies a wiring device incorporating the present invention. Device 10 is illustrated as a wall-mounted, duplex electrical receptacle. It will be understood that the present invention may be used in many different types of wiring devices, including, but not limited to, wall-mounted switches, terminal blocks, cord-mounted switches, cube taps, appliance housings, control panels—all of which are intended to be comprehended within the term "wiring device".

As is conventional, receptacle 10 includes a housing composed of upper and lower electrically-insulating plastic sections 12, 14. A metallic wall mounting strap 16 is mounted on the housing and has strap ends 18, 20 extending past opposite ends of the housing. Terminal screws 22 have heads exteriorly of the housing. In a conventional screw-type wiring connection, an end portion of an electrical conductor is stripped and coiled underneath an appropriate head before tightening the screw in order to connect the conductor to an interior terminal enclosed by the housing.

In a push-wire connection, a stripped or uninsulated end portion 24 (see FIG. 5) of a conductor 26 is electrically connected to an interior terminal, e.g., terminal strip 28 having a contact wall 30, by simply inserting the stripped portion 24 into a circular opening 32 (see FIG. 3) formed in, and extending through, the bottom housing section 14.

Figure 3:
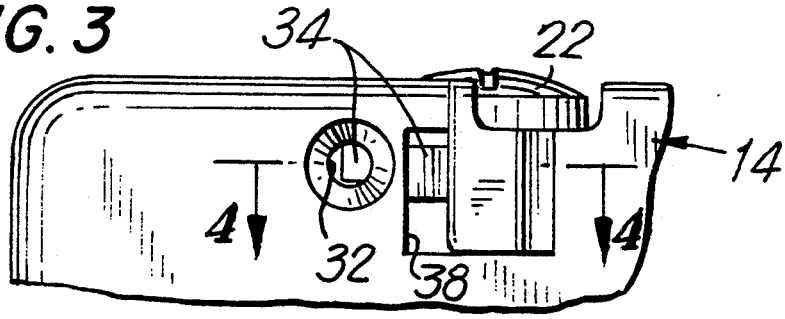
FIG. 3 is a broken-away, bottom plan view of the device of FIG. 1.
Figure 4:
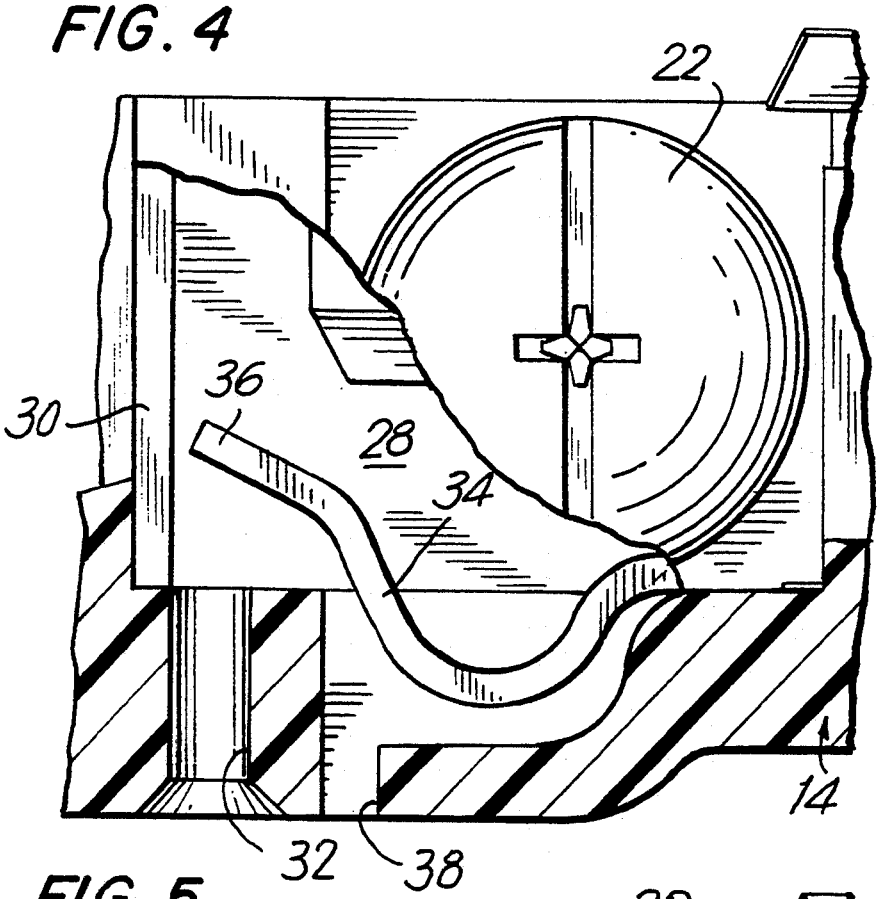
FIG. 4 is an enlarged, broken-away, sectional view taken on line 4—4 of FIG. 3 prior to insertion of an uninsulated end portion of an electrical conductor into a wiring device.
Figure 5:
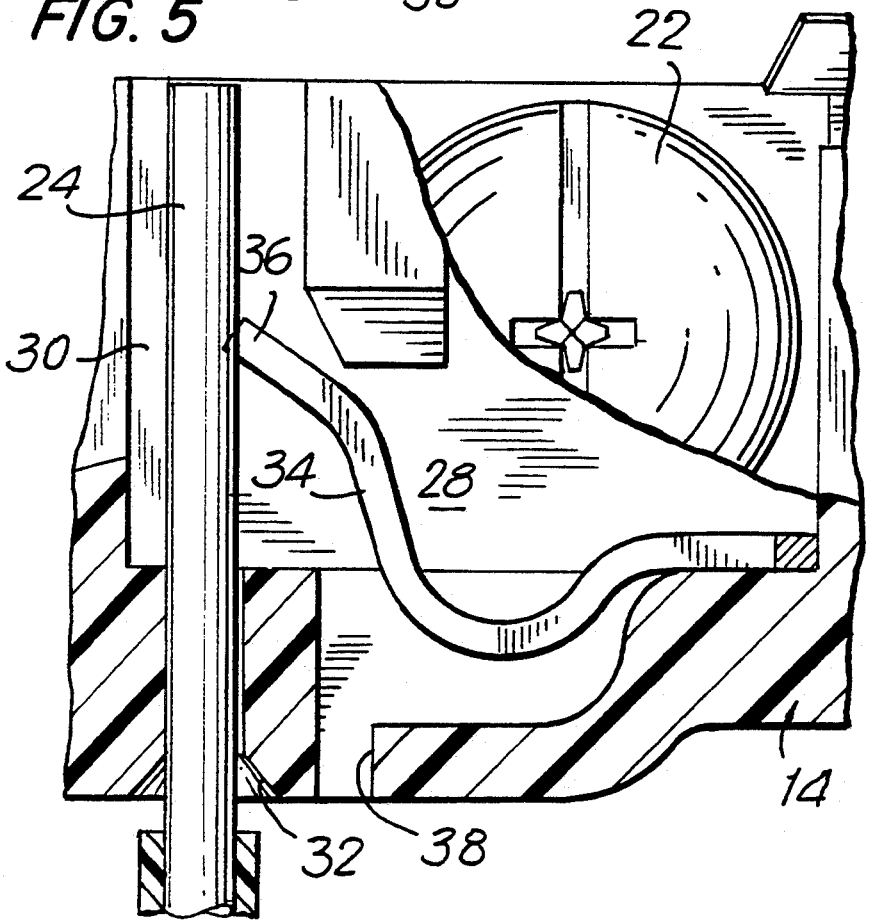
FIG. 5 is a view analogous to FIG. 4 after insertion of the conductor.

A cantilevered leaf spring or finger 34, typically integrally formed from the same piece of resilient sheet metal as the terminal strip 28, is arranged to partially overlie the opening 32 (see FIGS. 3 and 4). The terminal end 36 of the finger is biased by its inherent resilience toward the contact wall 30. When the stripped portion 24 is inserted through the opening 32, the stripped portion 24 engages the terminal end 36 and deflects the finger 34 against the inherent restoring force of the finger away from the contact wall 30. The terminal end 36 forcefully presses the stripped portion 24 against the contact wall 30 to complete the electromechanical connection. The finger is configured to allow axial entry of the stripped portion 24 in one direction into the housing, but to forcefully resist axial withdrawal of the stripped portion 24 in the opposite direction. As shown in FIG. 5, the terminal end 36 actually "bites" into the stripped portion 24 to resist any attempt to withdraw the stripped portion 24.

In order to effect such withdrawal, a release passage 38 is also formed in, and extends through, the bottom section 14 adjacent the opening 32. As described so far, the receptacle 10 is entirely conventional and, hence, a greater detailed description thereof is not believed to be necessary.

Now, in accordance with this invention, rather than attempting to obtain and properly manipulate a screwdriver of the correct size for insertion into the release passage 38 in order to deflect the finger 34 and release the stripped portion 24 from the receptacle, this invention proposes a release means or key 40 detachably connected to the wiring device. As shown in a first embodiment in FIG. 2, the key 40 is integral with the strap end 20 and is connected thereto along a score line 42 which is a weakened zone formed on the strap end 20. The strap 16 is formed from a metal planar sheet and, as shown, the key 40 is flat and has a handle 44 and a shank 46 projecting therefrom. The handle 44 is enlarged relative to the shank 46, as considered in a direction transverse to the elongation of the shank, thereby forming a stop or abutment shoulder 48.

The presence of the key 40 does not detract from the conventional operation of the device 10. The device can be wired to the conductor 26 either by a screw-type connection or by a push-wire connection, as shown in FIG. 5. If it is desired to remove the conductor 26 from the opening 32, a direct rearward pull would not be effective because the terminal end 36 of the finger 34 would prevent such withdrawal. To enable such withdrawal, the key 40 is detached from the strap end 20 by repeatedly flexing the key about the score line 42 until the key is broken off. Then the shank 46 of the detached key, as shown in FIG. 6, is inserted into the release passage until its shoulder 48 abuts against the exterior surface of the bottom wall section 14. Prior to such abutment, the leading end of the shank 46 engages and deflects the finger 34 away from the contact wall 30, thereby releasing and enabling the withdrawal of the stripped portion 24.

The cross-section of the release passage 38 is reduced, as compared to existing release passage cross-sections which are enlarged, in order to allow entry of screwdriver blades. The "closed-down" release passage 38 of this invention serves as a deterrent to any person attempting to insert a screwdriver blade into the release passage. The cross-section of the release passage 38 is of complementary contour to the cross-section of the key shank, thereby insuring a tight sliding fit. This feature minimizes the risk of twisting the key in the release opening and damaging the finger and/or the device housing. The shoulder 48 insures that the key will not be pushed in too far, again possibly damaging the finger.

Figure 2:
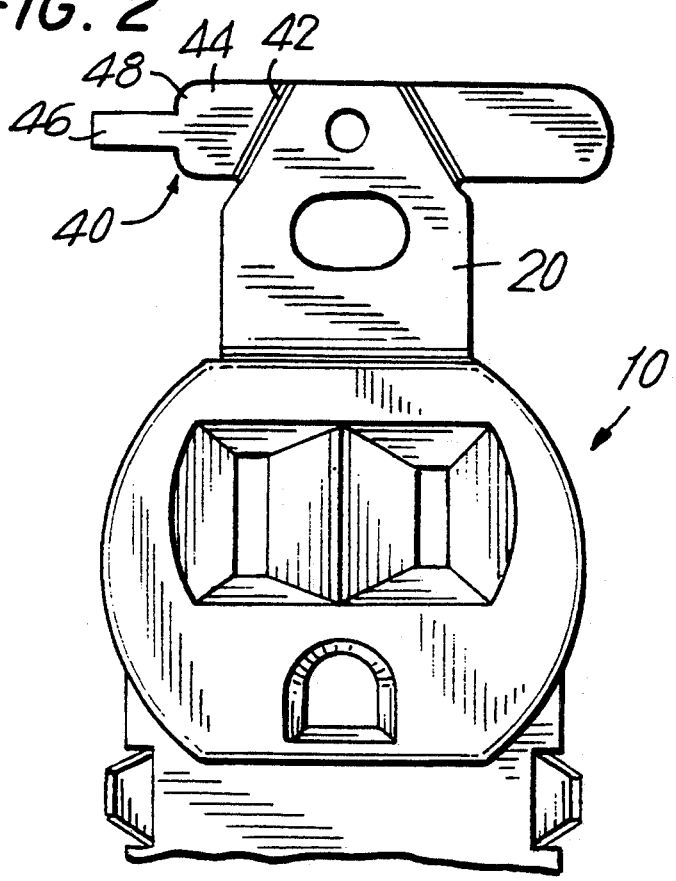
FIG. 2 is a broken-away, top plan view of the device of FIG. 1.

FIG. 7 depicts another embodiment of a break-off key completely analogous to that of the FIG. 2 embodiment and, hence, like reference numerals have been utilized. The only difference is the shape of the handle 44, which in the FIG. 7 embodiment is more circular, thereby more closely resembling a conventional circular plaster ear 50.

FIG. 8 depicts still another embodiment of a key. Rather than being formed of stamped metal from the mounting strap as in the case of the embodiments of FIGS. 2 and 7, the key 40 of FIG. 8 is formed of plastic from a molded plastic mounting strap. The plastic key 40 of FIG. 8 is severed from the plastic strap by repeated flexing along a weakened zone in a manner completely analogous to that described previously.

Whether metal or plastic, the generally planar key 40 requires some effort on the part of the installer to insert it into the release passage 38 to deflect the finger 34. This effort might cause the installer's fingers to be pinched or injured over time. Hence, this invention also contemplates inserting the key 40 of a second wiring device, e.g. 10' (FIG. 7) or 10'' (FIG. 8), while still remaining attached to the second wiring device, into the release passage 38 of a first wiring device 10, in order to deflect the finger 34 and remove the stripped portion 24, as described above. The housing sections 12, 14 of the second wiring device 10', 10'' serve as a convenient enlarged handle to better manipulate the key 40, without subjecting the installer's fingers to injury due to excessive pressure exerted thereon. The angled orientations of the shanks 46, as depicted in FIGS. 7 and 8, are particularly advantageous in securing an increased mechanical advantage.

This invention also contemplates, as shown in FIG. 9, the use of a separate key 40', essentially identical to key 40 in that it has a shank 46', a stop 48' and a handle 44', but already detached from the wiring device. The wiring device is otherwise conventional, except for the "closed-down" release passage 38 described above. The insertion of the separate key 40' into the release passage 38 to effect the removal of the stripped portion 24 would proceed as earlier described.

It will be understood that each of the elements described above, or two or more together, also may find a useful application in other types of constructions differing from the types described above.

While the invention has been illustrated and described as embodied in a break-off key for releasing push-wire connection in wiring devices, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A wiring device for push-wire connection with an uninsulated end portion of an electrical conductor, comprising:

(a) a housing having an electrical terminal therein, an opening through which the uninsulated end portion is insertable, and a release passage adjacent to the opening;

(b) locking means within the housing for locking the uninsulated end portion inserted through the opening in electrically-conductive contact with the terminal; and (c) release means detachably connected to the wiring device and, after detachment from the wiring device, being insertable into the release passage, for unlocking, and enabling removal of, the uninsulated end portion from the terminal.

2. The wiring device according to claim 1, wherein the housing has a mounting strap, and wherein the release means is integral with, and detachable from, the mounting strap.

3. The wiring device according to claim 2, wherein the strap has wall-mounting strap ends, and wherein the release means is a break-off key connected to one of the strap ends along a weakened zone.

4. The wiring device according to claim 3, wherein the strap and the key are constituted of a stamped metal material.

5. The wiring device according to claim 3, wherein the strap and the key are constituted of a molded synthetic plastic material.

6. The wiring device according to claim 1, wherein the release means is a break-off key having a shank with a predetermined cross-section, and wherein the release passage has a cross-section of complementary contour to said predetermined cross-section to slidably receive the key with minimal sliding clearance.

7. The wiring device according to claim 6, wherein each cross-section is generally rectangular.

8. The wiring device according to claim 1, wherein the release means is a break-off key having a stop for limiting insertion of the key into the release passage.

9. The wiring device according to claim 1, wherein the release means is a break-off key, and wherein the locking means is a resilient spring overlying the release passage and yieldable during insertion of the key into the release passage.

10. The wiring device according to claim 9, wherein the spring is a cantilever spring for biasing the uninsulated end portion against the terminal in a wired position, and for resisting movement of the uninsulated end portion out of the opening from the wired position until the key causes the spring to yield.

11. A wiring release arrangement, comprising:

(a) a first wiring device including a housing having an electrical terminal therein, an opening through which an uninsulated end portion of an electrical conductor is insertable, a release passage adjacent to the opening, and locking means within the housing for locking the uninsulated end portion inserted through the opening in electrically-conductive contact with the terminal;

(b) a second wiring device; and (c) release means attached to the second wiring device and, while remaining attached to the second wiring device, being insertable into the release passage of the first wiring device for unlocking, and enabling removal of, the uninsulated end portion from the terminal.

12. The arrangement according to claim 11, wherein the release means is a key having a shank with a predetermined cross-section, and wherein the release passage has a cross-section of complementary contour to said predetermined cross-section to slidably receive the key with minimal sliding clearance.

13. The arrangement according to claim 12, wherein each cross-section is generally rectangular.

14. The arrangement according to claim 11, wherein the release means is a key having a stop for limiting insertion of the key into the release passage.

15. The arrangement according to claim 11, wherein the release means is a key, and wherein the locking means is a resilient spring overlying the release passage and yieldable during insertion of the key into the release passage.

16. The arrangement according to claim 15, wherein the spring is a cantilever spring for biasing the uninsulated end portion against the terminal in a wired position, and for resisting movement of the uninsulated end portion out of the opening from the wired position until the key causes the spring to yield.

17. The arrangement according to claim 11, wherein the second wiring device includes a housing serving as a handle for manipulation of the release means.

* * * * *